US009863589B2

(12) United States Patent
Moon et al.

(10) Patent No.: US 9,863,589 B2
(45) Date of Patent: Jan. 9, 2018

(54) BULB-LIKE LED LAMP AND MANUFACTURING METHOD THEREOF

(71) Applicants: Sangpil Moon, Seoul (KR); Daisung Moon, Seoul (KR)

(72) Inventors: Sangpil Moon, Seoul (KR); Daisung Moon, Seoul (KR)

( * ) Notice: Subject to any disclaimer, the term of this patent is extended or adjusted under 35 U.S.C. 154(b) by 233 days.

(21) Appl. No.: 14/723,489

(22) Filed: May 28, 2015

(65) Prior Publication Data

US 2016/0230976 A1 Aug. 11, 2016

(30) Foreign Application Priority Data

Feb. 6, 2015 (CN) ..... 2015 2 0088807 U

(51) Int. Cl.

| | |
|---|---|
| ***F21V 21/00*** | (2006.01) |
| ***F21K 9/90*** | (2016.01) |
| ***F21V 17/16*** | (2006.01) |
| ***F21V 29/503*** | (2015.01) |
| ***F21K 9/232*** | (2016.01) |
| *F21Y 115/10* | (2016.01) |
| *F21Y 107/40* | (2016.01) |

(52) U.S. Cl.

CPC ..... *F21K 9/90* (2013.01); *F21K 9/232* (2016.08); *F21V 17/164* (2013.01); *F21V 29/503* (2015.01); *F21Y 2107/40* (2016.08); *F21Y 2115/10* (2016.08)

(58) Field of Classification Search

CPC ..... F21K 9/90; F21K 9/232; F21V 29/503; F21V 17/164

USPC ..... 362/249.02

See application file for complete search history.

(56) References Cited

FOREIGN PATENT DOCUMENTS

CN 203731344 U 7/2014

*Primary Examiner* — Andrew Coughlin
*Assistant Examiner* — Meghan Ulanday

(57) ABSTRACT

Described herein is a bulb-like LED lamp comprising a base, a lamp cover and a threaded cap, the lamp cover and the threaded cap are connected to two ends of the base respectively, wherein the base is sheathed with a heat-dissipation tube integrally formed by a first column tube and a first polygonal tube, a heat-dissipation plate is embedded in an opening end of the first polygonal tube, an exterior surface of the first polygonal tube is sheathed with an LED fixing loop and an LED board.

6 Claims, 3 Drawing Sheets

BULB-LIKE LED LAMP AND MANUFACTURING METHOD THEREOF

CROSS-REFERENCE TO PRIOR APPLICATION

This application claims the benefit of Chinese utility model patent application No. 201520088807.5, filed on Feb. 6, 2015, which is incorporated herein by reference.

FIELD OF THE INVENTION

The present invention relates to a bulb-like LED lamp and a manufacturing method thereof.

BACKGROUND OF THE INVENTION

A Chinese patent (CN201320830400.6) has disclosed an LED lamp having a heat dissipation system for dissipating heat timely to cool LED bulbs and thus extending service life of the LED lamp. The LED lamp comprises a base, a lamp body, a lamp cover matching the lamp body, an LED power driver arranged in the lamp body and an LED board arranged on the LED power driver. The heat dissipation system of the LED lamp comprises a plurality of heat-dissipation fins protruding from an inner wall of the lamp body, a plurality of heat-dissipation holes formed at an engaging portion of the lamp body and the lamp cover, and a plurality of heat-dissipation holes opened in a bottom of the lamp body. However, the appearance of such heat dissipation system is not attractive, and the heat dissipation system makes the LED lamp heavier than conventional bulb-like LED lamps, which may not satisfy customers' needs.

SUMMARY OF THE INVENTION

The present invention aims to provide a bulb-like LED lamp with high luminous efficiency, the light emitting angle and the appearance of the bulb-like LED lamp of the present application are very similar to that of conventional incandescent bulbs. The present invention also aims to provide a manufacturing method of the bulb-like LED lamp.

The present invention provides the following technical solutions. A bulb-like LED lamp comprising a base, a lamp cover and a threaded cap, the lamp cover and the threaded cap being connected to two ends of the base respectively, characterized in that the base is sheathed with a heat-dissipation tube integrally formed by a first column tube and a first polygonal tube, a heat-dissipation plate is embedded in an opening end of the first polygonal tube, an exterior surface of the first polygonal tube is sheathed with an LED fixing loop and an LED board.

Preferably, the base is consisted of a tube body having a threaded exterior surface, a ring extending upwardly and outwardly from one end of the tube body, a second column tube extending upwardly from the end of the tube body, a second polygonal tube integrally formed on the second column tube, a heat-dissipation-plate contacting surface arranged on a top of the second polygonal tube, a screw hole opened in a centre of the heat-dissipation-plate contacting surface, a wire hole near the screw hole and opened in the heat-dissipation-plate contacting surface, a circular groove formed between the ring and the second column tube, and a PCB received in the second column tube.

Preferably, the circular groove is consisted of a first circular groove, the first circular groove being positioned at an upper portion of the circular groove for receiving a lug located at an opening end of the lamp cover, and a second circular groove, the second circular groove being positioned at a lower portion of the circular groove and close to the second column tube for inserting the first column tube.

Preferably, the lug is fitted in a concave groove formed between an inward protrusion inwardly protruding from a top portion of the ring and an inner wall of the first circular groove.

Preferably, the lug is consisted of a plurality of circumferentially spaced protrusions outwardly protruding from the surface of the opening end of the lamp cover.

Preferably, the heat-dissipation tube is consisted of the first column tube, the first polygonal tube, a stopping element formed between the first column tube and the first polygonal tube, and a groove formed in an inner wall of the opening end of the first polygonal tube for embedding the heat-dissipation plate.

Preferably, the LED fixing loop is consisted of a loop body engaging with the first polygonal tube, and a blind groove formed in an inner wall of an opening end of the loop body for inserting an insertion element of the LED board.

Preferably, the LED board is consisted of a polygonal board, a plurality of side boards bound together and oriented perpendicular to the polygonal board, each side board protruding downwards from an edge of the polygonal board, a plurality of insertion elements each formed at a bottom of the side board, a notch formed between two insertion elements, LED light sources arranged on the polygonal board and on the side boards, a screw hole opened in a centre of the polygonal board, and a wire hole positioned near the screw hole and opened in the polygonal board.

The present invention also aims to provide a manufacturing method of the bulb-like LED lamp which comprises the following steps of:

step (1): placing a lead wire located at a bottom of a PCB of a base into a tip of a threaded cap, placing another lead wire located at the bottom of the PCB into a wall of a tube body of the base, threadedly connecting the base to the threaded cap, passing a lead wire located at a top of the PCB of the base through a wire hole of the base, a wire hole of a heat-dissipation plate and a wire hole of an LED board in sequence to electrically connect the wire to an LED light source;

step (2): after the step (1) is complete, sheathing the base with a heat-dissipation tube, inserting a lower portion of a first column tube of the heat-dissipation tube into a second circular groove of the base to abut an inner wall of a first polygonal tube of the heat-dissipation tube against an outer wall of a second polygonal tube of base, embedding the heat-dissipation plate into a groove at an opening end of the first polygonal tube of the heat-dissipation tube;

step (3): after the step (2) is complete, sheathing the first polygonal tube of the heat-dissipation tube with an LED fixing loop, abutting a bottom of the LED fixing loop against a stopping element of the heat-dissipation tube;

step (4): after the step (3) is complete, aligning a notch formed between two insertion elements of the LED board with a corner of the LED fixing loop, inserting an insertion element of the LED board into a blind groove of the LED fixing loop to fix the LED board to an exterior surface of the first polygonal tube of the heat-dissipation tube, passing a screw through a screw hole of the LED board, a screw hole of the heat-dissipation plate and a screw hole of a heat-dissipation-plate contacting surface of the base to fix the LED board, the heat-dissipation plate and the heat-dissipation tube to the base;

step (5): after the step (4) is complete, fitting a lug located at an opening end of a lamp cover into a concave groove formed in a first circular groove of the base.

Preferably, the base and the heat-dissipation tube are molded together as one piece.

Comparing with prior arts, the present invention has advantages as following.

(1) A large-volume lamp cover and a small-volume base of the bulb-like LED lamp make the structure of the bulb-like LED lamp very simple and make the appearance of the bulb-like LED lamp very attractive.

(2) The heat-dissipation tube is made of aluminum, so the heat-dissipation efficiency of the heat-dissipation tube of the present invention is comparable to that of conventional heat-dissipation fins.

(3) Duo to the LED light sources arranged on the polygonal board and on the side boards, the bulb-like LED lamp of the present invention has a high light intensity.

DETAILED DESCRIPTION OF ILLUSTRATED EMBODIMENTS

Various preferred embodiments will now be described with reference to the figures.

Figure 1:
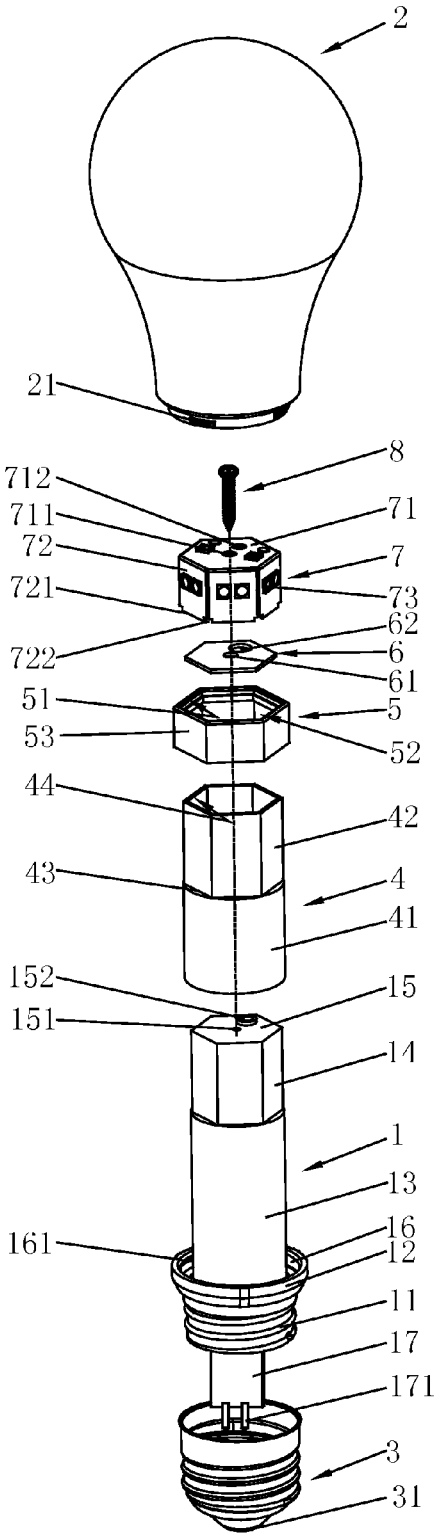
FIG. 1 is an exploded view of a bulb-like LED lamp of the present invention.
Figure 2:
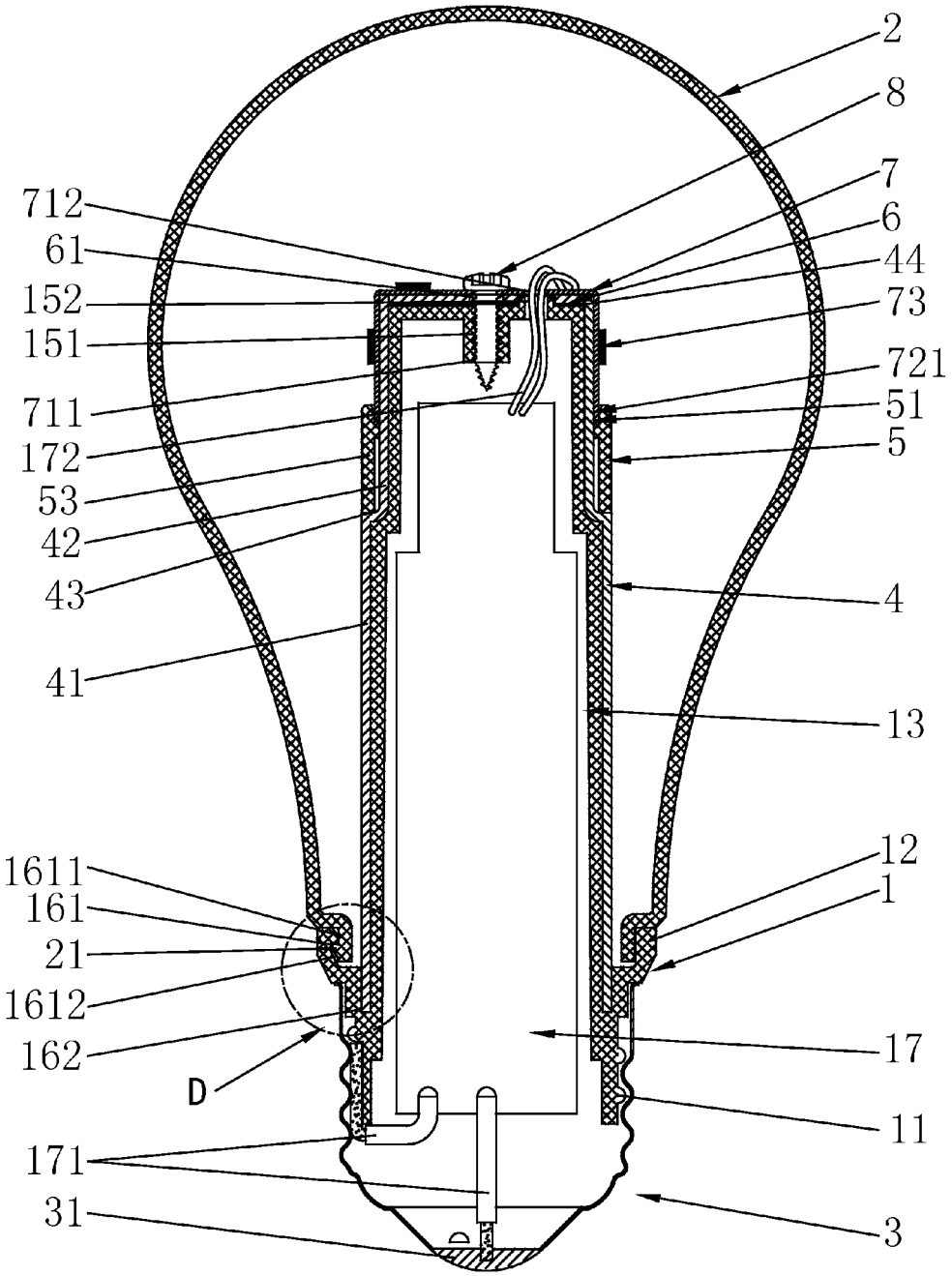
FIG. 2 is a cross-sectional view of an assembled bulb-like LED lamp of the present invention.
Figure 3:
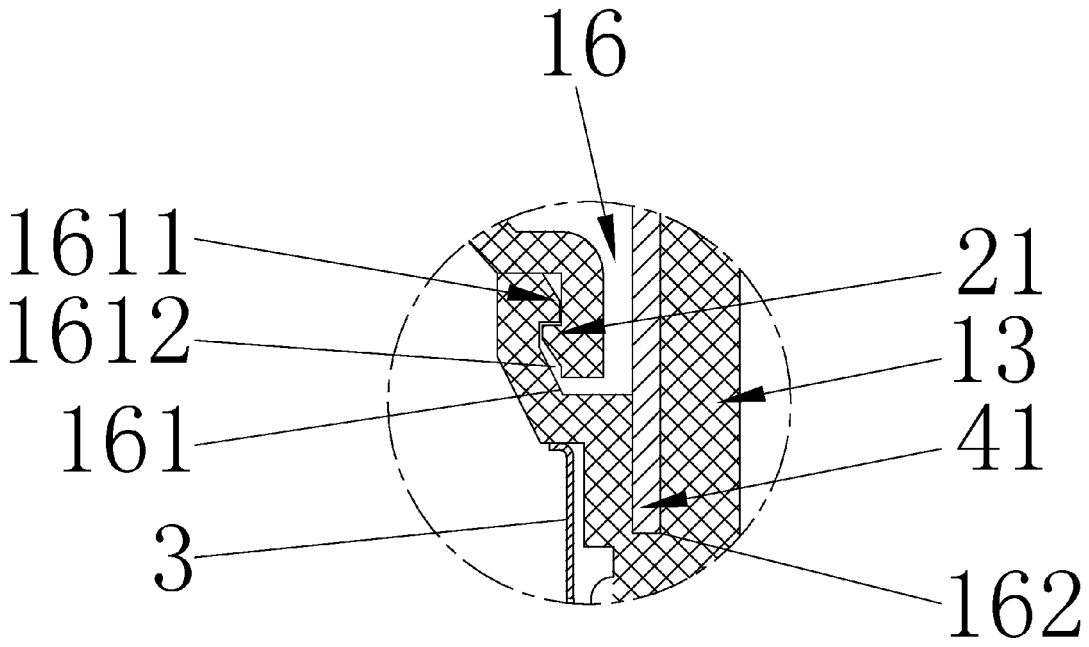
FIG. 3 is an enlarged view of a portion D indicated in FIG. 1.

As shown in FIGS. 1 and 2, a bulb-like LED lamp comprises a base 1, a lamp cover 2 connected to one end of the of the base 1, a threaded cap 3 connected to the other end of the base 1, a heat-dissipation tube 4 sheathing the base 1 and integrally formed by a first column tube 41 and a first polygonal tube 42, a heat-dissipation plate 6 embedded in an opening end of the first polygonal tube 42, an LED fixing loop 5, and an LED board 7 both sheathing an exterior surface of the first polygonal tube 42.

In this embodiment, the base 1 is consisted of a tube body 11 having a threaded exterior surface, a ring 12 extending upwardly and outwardly from one end of the tube body 11, a second column tube 13 extending upwardly from the end of the tube body 11, a second polygonal tube 14 integrally formed on the second column tube 13, a heat-dissipation-plate contacting surface 15 arranged on a top of the second polygonal tube 14, a screw hole 151 opened in a centre of the heat-dissipation-plate contacting surface 15, a wire hole 152 near the screw hole 151 and opened in the heat-dissipation-plate contacting surface 15, a circular groove 16 formed between the ring 12 and the second column tube 13, and a PCB 17 received in the second column tube 13.

Figure 4:
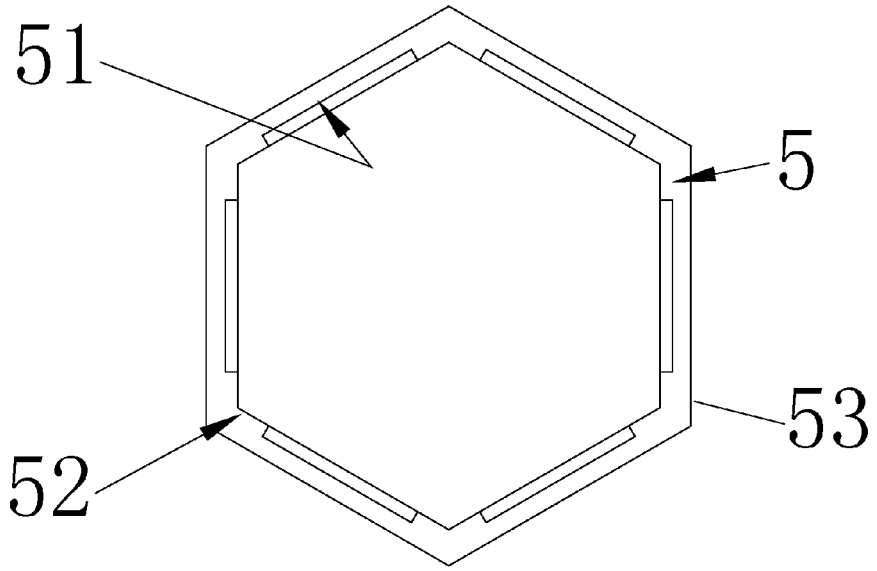
FIG. 4 is enlarged view of an LED fixing loop of a bulb-like LED lamp of the present invention.

As shown in FIGS. 1, 2 and 4, the circular groove 16 is consisted of a first circular groove 161 at an upper portion of the circular groove 16 for receiving a lug 21 located at an opening end of the lamp cover 2, and a second circular groove 162 at a lower portion of the circular groove 16 and close to the second column tube 13 for inserting the first column tube 41.

In this embodiment, the lug 21 is fitted in a concave groove 1612 formed between an inward protrusion 1611 inwardly protruding from a top portion of the ring 12 and an inner wall of the first circular groove 161.

In this embodiment, the lug 21 is consisted of a plurality of circumferentially spaced protrusions outwardly protruding from the surface of the opening end of the lamp cover 2.

In this embodiment, the heat-dissipation tube 4 is consisted of the first column tube 41, the first polygonal tube 42, a stopping element 43 formed between the first column tube 41 and the first polygonal tube 42, and a groove 44 formed in an inner wall of the opening end of the first polygonal tube 42 for embedding the heat-dissipation plate 6.

As shown in FIGS. 1, 2 and 4, the LED fixing loop 5 is consisted of a loop body 53 engaging with the first polygonal tube 42, and a blind groove 51 formed in an inner wall of an opening end of the loop body 53 for inserting an insertion element 721 of the LED board 7.

In this embodiment, the LED board 7 is consisted of a polygonal board 71, a plurality of side boards 72 bound together and oriented perpendicular to the polygonal board 71, each side board 72 protruding downwards from an edge of the polygonal board 71, a plurality of insertion elements 721 each formed at a bottom of the side board 71, a notch 722 formed between two insertion elements 721, LED light sources 73 arranged on the polygonal board 71 and on the side boards 72, a screw hole 711 opened in a centre of the polygonal board 71, and a wire hole 712 positioned near the screw hole 711 and opened in the polygonal board 71.

Referring to FIG. 1-4, a manufacturing method of the bulb-like LED lamp comprises the following steps of:

step (1): placing a lead wire 171 located at a bottom of a PCB 17 of a base 1 into a tip 31 of a threaded cap 3, placing another lead wire 171 located at the bottom of the PCB 17 into a wall of a tube body 11 of the base 1, threadedly connecting the base 1 to the threaded cap 3, passing a lead wire 172 located at a top of the PCB 17 of the base 1 through a wire hole 152 of the base, a wire hole 62 of a heat-dissipation plate 6 and a wire hole 712 of an LED board 7 in sequence to electrically connect the lead wire 172 to an LED light source 73;

step (2): after the step (1) is complete, sheathing the base 1 with a heat-dissipation tube 4, inserting a lower portion of a first column tube 41 of the heat-dissipation tube 4 into a second circular groove 162 of the base 1 to abut an inner wall of a first polygonal tube 42 of the heat-dissipation tube 4 against an outer wall of a second polygonal tube 14 of base 1, embedding the heat-dissipation plate 6 into a groove 44 at an opening end of the first polygonal tube 42 of the heat-dissipation tube 4;

step (3): after the step (2) is complete, sheathing the first polygonal tube 42 of the heat-dissipation tube 4 with an LED fixing loop 5, abutting a bottom of the LED fixing loop 5 against a stopping element 43 of the heat-dissipation tube 4;

step (4): after the step (3) is complete, aligning a notch 722 formed between two insertion elements 721 of the LED board 7 with a corner 52 of the LED fixing loop 5, inserting an insertion element 721 of the LED board 7 into a blind groove 51 of the LED fixing loop 5 to fix the LED board 7 to an exterior surface of the first polygonal tube 42 of the heat-dissipation tube 4, passing a screw 8 through a screw hole 711 of the LED board 7, a screw hole 61 of the heat-dissipation plate 6 and a screw hole 151 of a heat-dissipation-plate contacting surface 15 of the base 1 to fix the LED board 7, the heat-dissipation plate 6 and the heat-dissipation tube 4 to the base 1;

step (5): after the step (4) is complete, fitting a lug 21 located at an opening end of a lamp cover 2 into a concave groove 1612 formed in a first circular groove 161 of the base 1.

In another embodiment, the base 1 and the heat-dissipation tube 4 are molded together as one piece.

All the above are the preferred embodiments of the present invention, and the invention is intended to cover various modifications and equivalent arrangements included within the scope of the invention.

LIST OF REFERENCE NUMERALS OF MAIN COMPONENTS

1 base
11 tube body
12 ring
13 second column tube
14 second polygonal tube
15 heat-dissipation-plate contacting surface
151 screw hole
152 wire hole
16 circular groove
161 first circular groove
1611 inward protrusion
1612 concave groove
162 second circular groove
17 PCB
171 lead wire
172 lead wire
2 lamp cover
21 lug
3 threaded cap
31 tip of threaded cap
4 heat-dissipation tube
41 first column tube
42 first polygonal tube
43 stopping element
44 groove
5 LED fixing loop
51 blind groove
52 corner
53 loop body
6 heat-dissipation plate
61 screw hole
62 wire hole
7 LED board
71 polygonal board
711 screw hole
712 wire hole
72 side board
721 insertion element
722 notch
73 LED light source
8 screw

What is claimed is:

1. A bulb-like LED lamp comprising a base, a lamp cover and a threaded cap, the lamp cover and the threaded cap being connected to two ends of the base respectively, characterized in that the base is sheathed with a heat-dissipation tube integrally formed by a first column tube and a first polygonal tube, a heat-dissipation plate is embedded in an opening end of the first polygonal tube, an exterior surface of the first polygonal tube is sheathed with an LED fixing loop and an LED board;

wherein the base is consisted of : a tube body having a threaded exterior surface, a ring extending upwardly and outwardly from one end of the tube body, a second column tube extending upwardly from the end of the tube body, a second polygonal tube integrally formed on the second column tube, a heat-dissipation-plate contacting surface arranged on a top of the second polygonal tube, a screw hole opened in a centre of the heat-dissipation-plate contacting surface, a wire hole near the screw hole and opened in the heat-dissipation-plate contacting surface, a circular groove formed between the ring and the second column tube, and a PCB received in the second column tube;

wherein the circular groove is consisted of: a first circular groove, the first circular groove being positioned at an upper portion of the circular groove for receiving a lug located at an opening end of the lamp cover, and a second circular groove, the second circular groove being positioned at a lower portion of the circular groove and close to the second column tube for inserting the first column tube;

the lug is fitted in a concave groove formed between an inward protrusion inwardly protruding from a top portion of the ring and an inner wall of the first circular groove;

wherein the LED board is consisted of: a polygonal board, a plurality of side boards bound together and oriented perpendicular to the polygonal board, each side board protruding downwards from an edge of the polygonal board, a plurality of insertion elements each formed at a bottom of the side board, a notch formed between two insertion elements, LED light sources arranged on the polygonal board and on the side boards, a screw hole opened in a centre of the polygonal board, and a wire hole positioned near the screw hole and opened in the polygonal board.

2. The bulb-like LED lamp according to claim 1, characterized in that the lug is consisted of a plurality of circumferentially spaced protrusions outwardly protruding from the surface of the opening end of the lamp cover.

3. The bulb-like LED lamp according to claim 1, characterized in that the heat-dissipation tube is consisted of the first column tube, the first polygonal tube, a stopping element formed between the first column tube and the first polygonal tube, and a groove formed in an inner wall of the opening end of the first polygonal tube for embedding the heat-dissipation plate.

4. The bulb-like LED lamp according to claim 1, characterized in that the LED fixing loop is consisted of a loop body engaging with the first polygonal tube, and a blind groove formed in an inner wall of an opening end of the loop body for inserting an insertion element of the LED board.

5. A manufacturing method of a bulb-like LED lamp comprising the following steps of:

step (1): placing a lead wire located at a bottom of a PCB of a base into a tip of a threaded cap, placing another lead wire located at the bottom of the PCB into a wall of a tube body of the base, threadedly connecting the base to the threaded cap, passing a lead wire located at a top of the PCB of the base through a wire hole of the base, a wire hole of a heat-dissipation plate and a wire hole of an LED board in sequence to electrically connect the wire to an LED light source;

step (2): after the step (1) is complete, sheathing the base with a heat-dissipation tube, inserting a lower portion of a first column tube of the heat-dissipation tube into a second circular groove of the base to abut an inner wall of a first polygonal tube of the heat-dissipation tube against an outer wall of a second polygonal tube of base, embedding the heat-dissipation plate into a groove at an opening end of the first polygonal tube of the heat-dissipation tube;

step (3): after the step (2) is complete, sheathing the first polygonal tube of the heat-dissipation tube with an LED fixing loop, abutting a bottom of the LED fixing loop against a stopping element of the heat-dissipation tube;

step (4): after the step (3) is complete, aligning a notch formed between two insertion elements of the LED board with a corner of the LED fixing loop, inserting an insertion element of the LED board into a blind groove of the LED fixing loop to fix the LED board to an exterior surface of the first polygonal tube of the heat-dissipation tube, passing a screw through a screw hole of the LED board, a screw hole of the heat-dissipation plate and a screw hole of a heat-dissipation-plate contacting surface of the base to fix the LED board, the heat-dissipation plate and the heat-dissipation tube to the base;

step (5): after the step (4) is complete, fitting a lug located at an opening end of a lamp cover into a concave groove formed in a first circular groove of the base.

6. The manufacturing method of a bulb-like LED lamp according to claim 5, characterized in that the base and the heat-dissipation tube are molded together as one piece.

* * * * *